US009587844B2

(12) United States Patent
Darwinkel et al.

(10) Patent No.: US 9,587,844 B2
(45) Date of Patent: Mar. 7, 2017

(54) HUMIDIFIER AND A METHOD OF MONITORING THE WATER LEVEL IN THE HUMIDIFIER

(71) Applicant: KONINKLIJKE PHILIPS N.V., Eindhoven (NL)

(72) Inventors: Geert-Jan Darwinkel, Winsum (NL); Timothy Van Der Graaf, Groningen (NL); Wilhelmina Johanna Gerarda Van De Wassenberg, Veldhoven (NL); Jan Buffinga, Drachten (NL); Jacob Dijkstra, Zwaagwesteinde (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 249 days.

(21) Appl. No.: 14/361,108

(22) PCT Filed: Nov. 23, 2012

(86) PCT No.: PCT/IB2012/056682

§ 371 (c)(1),
(2) Date: May 28, 2014

(87) PCT Pub. No.: WO2013/080107

PCT Pub. Date: Jun. 6, 2013

(65) Prior Publication Data

US 2014/0346688 A1 Nov. 27, 2014

Related U.S. Application Data

(60) Provisional application No. 61/566,036, filed on Dec. 2, 2011.

(51) Int. Cl.
*F24F 6/00* (2006.01)
*F24F 11/00* (2006.01)

(52) U.S. Cl.
CPC ..... *F24F 6/00* (2013.01); *F24F 11/0012* (2013.01); *F24F 2006/008* (2013.01)

(58) Field of Classification Search
CPC ..... F24F 6/00; F24F 11/0012; F24F 2006/008
USPC ..... 261/128, 129
See application file for complete search history.

(56) References Cited

U.S. PATENT DOCUMENTS

| | | | | |
|---|---|---|---|---|
| 4,672,842 | A * | 6/1987 | Hasselmann | G01F 1/007 374/115 |
| 5,278,937 | A | 1/1994 | Alix et al. | |
| 5,873,357 | A | 2/1999 | Lake | |
| 6,078,729 | A | 6/2000 | Kopel | |
| 6,948,364 | B2 | 9/2005 | Snelling et al. | |
| 7,181,965 | B2 | 2/2007 | Kearney et al. | |

(Continued)

FOREIGN PATENT DOCUMENTS

| | | |
|---|---|---|
| EP | 1020714 A2 | 7/2000 |
| JP | 2008086585 A | 4/2008 |

*Primary Examiner* — Charles Bushey

(57) ABSTRACT

The present invention relates to a humidifier and a method of monitoring the water level in the humidifier, the method comprising the steps of: detecting the temperature at the air outlet of the humidifier and generating temperature signals indicating the temperature thereof (310, 410); determining the water level in the humidifier according to the generated temperature signals (330, 430). The water level in the humidifier can be monitored using a rather simple structure yielding a high accuracy.

13 Claims, 3 Drawing Sheets

(56) References Cited

U.S. PATENT DOCUMENTS

| | | | | |
|---|---|---|---|---|
| 7,287,426 | B2 | 10/2007 | Frank | |
| 2004/0000335 | A1 | 1/2004 | Kopel | |
| 2006/0272830 | A1* | 12/2006 | Fima | E03B 1/00 169/16 |
| 2011/0066032 | A1 | 3/2011 | Vitek et al. | |

* cited by examiner

HUMIDIFIER AND A METHOD OF MONITORING THE WATER LEVEL IN THE HUMIDIFIER

CROSS-REFERENCE TO PRIOR APPLICATIONS

This application is the U.S. National Phase application under 35 U.S.C. §371 of International Application No. PCT/IB2012/056682, filed on Nov. 23, 2012 which claims the benefit of U.S. Provisional Patent Application No. 61/566,036 filed on Dec. 2, 2011. These applications are hereby incorporated by reference herein.

FIELD OF THE INVENTION

The present invention generally relates to a humidifier, and especially to a more simple and efficient humidifier and a method of monitoring the water level in the humidifier.

BACKGROUND OF THE INVENTION

Humidifiers are widely used in the household environment. As is known, a humidifier can be used to provide an appropriate humidity level, which may be necessary for some kinds of furniture and/or devices and which makes people feel comfortable.

Nevertheless, there is still something that could be improved. For instance, the water in the humidifier should be sufficient and above an appropriate level when the humidifier is in operation. If there is not enough water in the humidifier, the humidifying function will stop working, and the supply power is wasted. More disadvantageously, continuous heating when the humidifier is low on water will bring potential risk, like a fire hazard. To avoid this, a user has to observe the water level frequently. One solution is to store more water in the tank of the humidifier, but this causes the size of the humidifier and hence the manufacturing cost to be increased. Thus, there is a growing need for automatic monitoring of the water level of a humidifier.

In the prior art, there is known a humidifier in which a float in combination with a reed switch (magnet interaction) is used for detecting the low water condition thereof. A magnet is attached to the float at a predetermined level of the water stored in the water reservoir. When the water is below said predetermined level, the float and the associated magnet will also be lower than the predetermined level, and therefore trigger the reed switch. However, such a humidifier is difficult to clean, because the float and the switch must be arranged at the bottom of the reservoir and thus the user cannot clean the space underneath. Secondly, its accuracy is not very good. When the reed switch is out of range, there may still be a relatively high level of water left due to a stacked tolerance spectrum.

SUMMARY OF THE INVENTION

In respect of the disadvantages of the prior art, the present invention aims at providing a simple device and method for automatically monitoring the water level in a humidifier.

The present invention is based on the insight that the temperature at the air outlet of a humidifier is effectively lowered when the air downstream carries enough cold water vapor through the air outlet. That is to say, there is still enough water in the humidifier for normal operation. On the other hand, when the humidifier is running out of water, the air downstream passing through the air outlet carries less cold water vapor, and therefore the temperature at the air outlet does not decrease significantly. Thus, the water in the humidifier is not enough and the actual water level is too low.

According to a first aspect of the invention, a humidifier is provided comprising:

a water level monitoring unit which comprises: a temperature sensor for detecting the temperature at an air outlet of the humidifier and for generating temperature signals indicating the temperature thereof at a predetermined frequency; and a processor for determining the water level in the humidifier according to the temperature signals. By sampling the temperature at the air outlet, the humidifier can derive whether the temperature is effectively lowered by the water vapor passing through the air outlet when the humidifier is working, thereby determining whether there is enough water in the humidifier. Compared with the reed-switch in the prior art, the humidifier according to one embodiment of the present invention is simpler in structure and has a higher accuracy.

In an embodiment of the humidifier, the temperature sensor is arranged to detect the temperature signals at a first predetermined frequency during a first operational time period, and the first predetermined sampling frequency ranges from approximately once every 3 seconds to once every 15 seconds, preferably every 7 seconds. The first operational time period is from turn-on till a first time point of the humidifier operation.

Furthermore, in said embodiment of the humidifier, the processor is arranged to: determine the water level in the humidifier by calculating the slope of the temperature decrease from a series of consecutive temperature signals and compare it with a predetermined temperature decreasing slope, during the first operational time period. For instance, the processor determines whether the slope of the temperature decrease derived from consecutive sampled temperature signals, preferably 5 consecutive sampled temperature signals in the first operational time period, is in a range of, for example, 0.15-0.45° C. per 45 seconds; and if so, it identifies that there is enough water in the humidifier, or if not, it identifies that there is not enough water in the humidifier.

In another embodiment of the humidifier, the temperature sensor is arranged to detect the temperature signal at a second predetermined frequency during a second operational time period, and the second predetermined sampling frequency is in a range of about once every 15-50 seconds, preferably every 30 seconds; the second operational time period is after a first time point of operation of the humidifier. Furthermore, in the humidifier, the processor means is arranged to: determine the water level in the humidifier by calculating the slope of the temperature decrease from a series of consecutive temperature signals and compare it with a predetermined temperature decreasing slope, during the first operational time period. For instance, the processor determines whether the slope of the temperature increase is in a range of, for example, 0.05-0.35° C. per 30 seconds, from consecutive sampled temperature signals, preferably 10 consecutive sampled temperature signals in the second operational time period; and if so, it identifies that there is no substantial level of water in the humidifier, or if not, it identifies that there is a substantial level of water in the humidifier.

In addition, in the humidifier according to an embodiment of the invention, the first time period of operation of the humidifier lasts for about 3-10, preferably 5, minutes.

In another embodiment of the humidifier, the water level monitoring unit further comprises an alert unit, which issues a signal indicating that the humidifier needs to be filled with water, following an instruction from the processor upon determining that there is no substantial level of water in the humidifier.

In another embodiment of the humidifier, the processor is arranged to issue an instruction to turn down the humidifier apparatus upon determining that there is no substantial level of water in the humidifier.

According to a second aspect of the invention, a method of monitoring the water level in a humidifier is provided, wherein the method comprises the steps of: detecting the temperature at the air outlet of the humidifier and generating temperature signals indicating the temperature thereof; and determining the water level in the humidifier by the processor according to the generated temperature signals.

According to a preferred embodiment of the method of the invention, the method further comprises the step of sampling the temperature signals at a first pre-determined frequency during a first operational time period, the first operational time period being from turn-on to a first time point of operation of the humidifier, and wherein the step of determining comprises: determining the water level in the humidifier by calculating the temperature decreasing slope from a series of consecutive temperature signals and comparing it with a predetermined temperature decreasing slope, during the first operational time period. For instance, when a predetermined temperature decreasing slope is shown by consecutive temperature signals, preferably 5 consecutive temperature signals, during the first operational time period, it can be determined that the water level is high or appropriate; otherwise, it can be determined that the water level is low or inappropriate or zero. In addition, the first predetermined sampling frequency is in a range of about once every 3-15 seconds, preferably every 7 seconds.

According to another preferred embodiment of the method of the invention, the method further comprises the step of sampling the temperature signals at a second predetermined frequency during a second operational time period, the second operational time period being after a first time point of humidifier operation; and wherein the step of determining comprises: determining the water level in the humidifier by calculating the temperature increasing slope from a series of consecutive temperature signals and comparing it with a predetermined temperature increasing slope, during the second operational time period. For instance, when a predetermined temperature increasing slope is shown by consecutive temperature signals, preferably 10 consecutive temperature signals, during the second operational time period, it can be determined that the water level is low or inappropriate or zero. In addition, the second predetermined frequency is in a sampling range of about once every 15-50 seconds, preferably every 30 seconds.

According to another preferred embodiment of the method of the invention, the method further comprises the step of: when the water level of the humidifier is determined as being low or inappropriate or zero, indicating that the humidifier needs to be filled with water and/or turning down the humidifier.

By virtue of the invention, at least some advantages will be achieved, namely that the structure of the humidifier will be more simple and robust, and the cost of manufacturing such a humidifier will be reduced, because the need for an expensive and complex Reed switch is eliminated.

These and other aspects of the invention will be apparent from and elucidated with reference to the embodiment(s) described hereinafter.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1A:
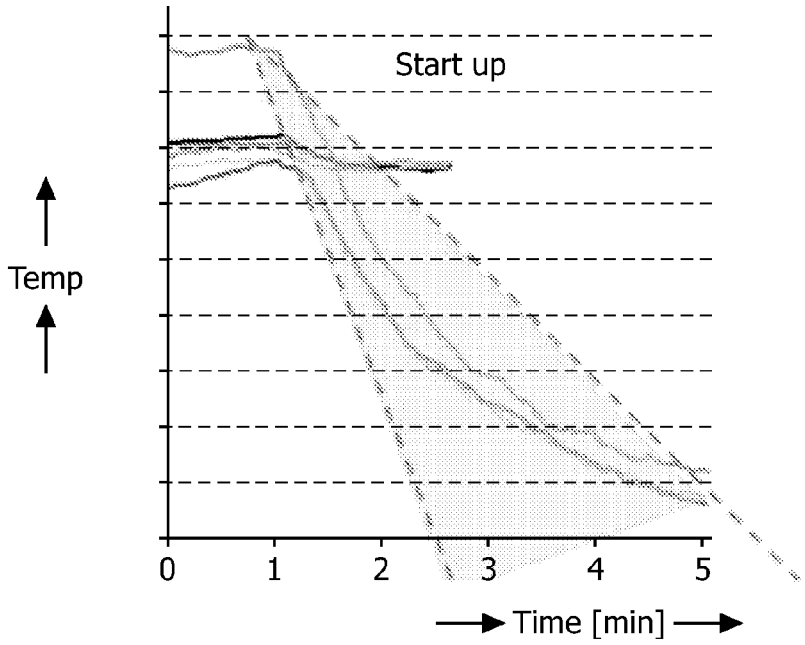
FIG. 1*a* schematically illustrates a curve in which temperature is plotted against time at the air outlet during the initial phase of operation of a humidifier, which shows the principle of the water monitoring unit of the invention.
Figure 1B:
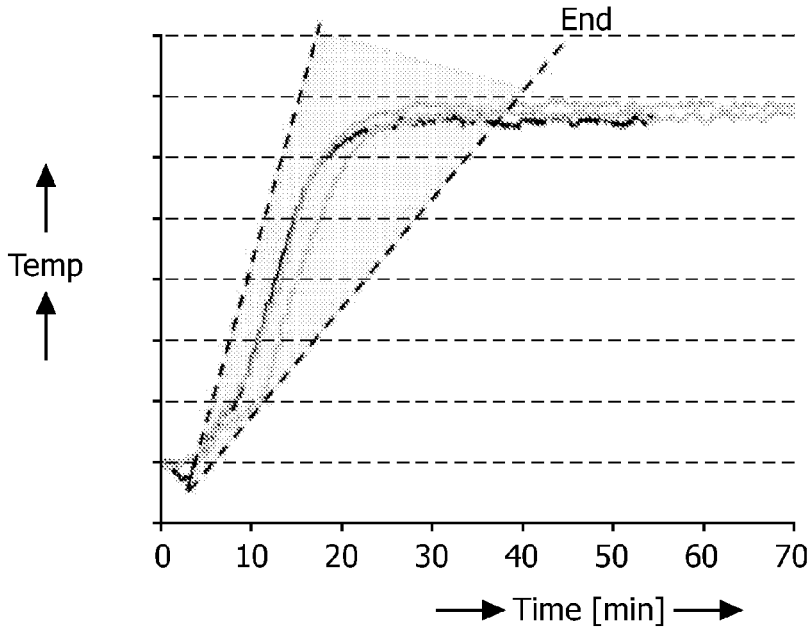
FIG. 1*b* schematically illustrates a curve in which temperature is plotted against time at the air outlet during an end phase of operation of a humidifier, which shows the principle of the water monitoring unit of the invention.

FIG. 1 shows the principle of the water monitoring unit of the invention. FIG. 1*a* schematically illustrates a curve in which temperature is plotted against time at the air outlet during the initial phase of operation of a humidifier, and FIG. 1*b* schematically illustrates a curve in which temperature is plotted against time at the air outlet during an end phase of operation of the humidifier. It can be seen from FIG. 1 that when the humidifier is not in operation, the temperature at the outlet equals the environmental temperature. The environmental temperature at home or in the work environment is set at about 18-26° C., preferably 24° C. However, after the humidifier is switched on, it will emit water vapor from the air outlet to enhance environment humidity. Generally, the temperature of the water vapor is below the environmental temperature. The cold water vapor passing through the air outlet will significantly change the environmental temperature. This is shown in FIG. 1*a* as a continuously decreasing slope that decreases from the environmental temperature to a certain temperature. Similarly, when the water runs out, there is no cold water vapor passing through the air outlet and the temperature at the air outlet will increase continuously to the environmental temperature. This is shown in FIG. 1*b* as a continuously increasing slope.

Figure 2:
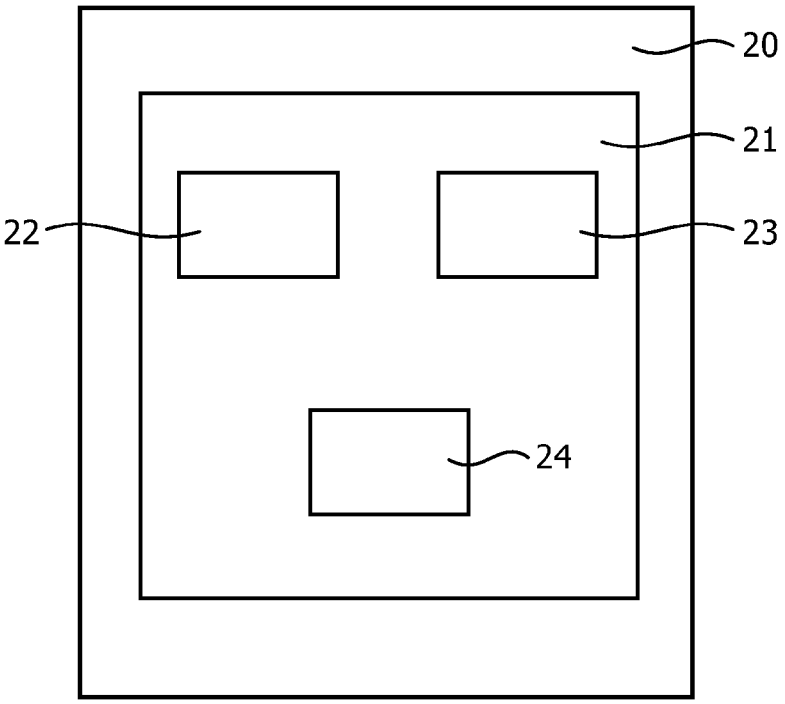
FIG. 2 schematically illustrates a block diagram of the structure of a humidifier according to an embodiment of the invention.

FIG. 2 schematically illustrates a block diagram of the structure of a humidifier 20 according to an embodiment of the invention. The humidifier 20 comprises a water level monitoring unit 21 which is arranged to monitor the water level in the humidifier 20, as well as the common members of a humidifier as known from the prior art, such as a body member, an air inlet, an air outlet and so on. Furthermore, the water level monitoring unit 21 in the humidifier according to the invention comprises a temperature sensor 22, which is positioned at or at least near the air outlet of the humidifier and which is arranged to detect the temperature at the air outlet and generate corresponding signals indicating the temperature at the air outlet while the humidifier is working. The water level monitoring unit 21 also comprises a processor 23, which is arranged to determine the water level in the humidifier by use of the signals indicating the temperature. It is obvious to the technicians skilled in the relevant fields that there can be some other elements in the water level monitoring unit and in the humidifier, such as electrical connections, a circuit board.

The further technical contents of the humidifier according to the invention will be explained by means of the following examples.

Example 1

Based on the structures of the humidifier as described above, the water level monitoring unit 21 of the humidifier, according to an embodiment of the invention, also comprises a sampler 24 which is arranged to sample the signals generated by the temperature sensor 22 and indicate the temperature thereof with a certain frequency. Especially, the sampler can be a member separated from the temperature sensor of the water level monitoring unit. It is thus connected to the temperature sensor 22 to receive signals therefrom and connected to the processor 23 to send the sampled signals thereto. As an alternative, the sampler can be a part of the temperature sensor 22. That is to say, the function of the sampler could be integrated in the temperature sensor 22. In addition, as an alternative, the sampler can be part of the processor unit 23. That is to say, the function of the sampler could be integrated in the processor.

To simplify the description, the separate sampler is used as an example to explain the corresponding technical contents, but actually the sampler inside the temperature sensor or the processor or other members has similar functions and operations.

Figure 3:
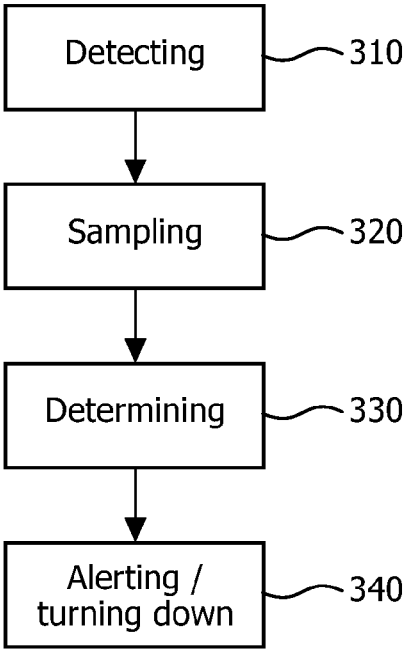
FIG. 3 shows a flow chart during the initial phase of operation of a humidifier, according to an exemplary embodiment.

The temperature sensor 22, the sampler 24 and the processor 23 as mentioned above are arranged to work together so as to implement such mechanisms as illustrated below and shown in FIG. 3.

In step 310, the temperature sensor 22 will continuously detect and measure the temperature at the air outlet during operation of the humidifier, and therefore generate signals representing the temperatures at the air outlet. As will be understood, there may be several kinds of known temperature sensors in the prior art, such as a temperature-resistance sensor where the electrical resistance is dependent on the temperature and thus correlates with the temperature. In other words, the resistance values can be used to represent the temperature.

In step 320, the temperature signals generated by the temperature sensor 22 are sent to the processor 23 with a first frequency during the initial phase of the humidifier's operation. The initial phase of the humidifier's operation is a time period from start-up of humidifier operation to a predetermined time point, such as after it has already operated for more than 5 minutes. The first frequency relates to sampling the signals every 3-15 seconds, preferably approximately every 7 seconds. Actually, the first frequency can have other appropriate values, depending on design limitations, which will be clear to the ordinary technician. And the first time point can also be a different time point, depending on particular design considerations.

In step 330, the processor 23 processes the sampled temperature signals and indicates the temperature at the air-let. During the initial phase of the humidifier's operation, the processor is arranged to determine the inclination of temperature changes from a series of consecutive temperature signals, such as 5 consecutive signals. Especially, the processor 23 is further arranged to determine whether the rate of temperature decrease reaches a substantial predetermined value, which means that the water vapor effectively lowers the temperature at the air outlet, and this indirectly implies that there is still enough water in the humidifier. The processor calculates the slope of the temperature decrease from the sampled signals and compares it with a predetermined value or a range, which can be designated by a user.

In a special example, if the slope indicating the temperature decrease with respect to time reaches a range of 0.15-0.45° C. per 45 seconds in the initial phase, then it can be inferred that the water level in the humidifier is still appropriate. In other words, the water level is identified as "high" or "appropriate". Otherwise, if the slope of the temperature decrease does not reach a range of 0.15-0.45° C. per 45 seconds in the initial phase, then it can be inferred that there is not enough water in the humidifier. In other words, the water level is identified as "low" or "inappropriate". It should be noted that other ranges may be also meaningful for describing the corresponding technical aspects and content, when considering circumstances such as air temperature, water temperature, and so on.

In step 340, when the processor 23 determines that the water in the humidifier is below an appropriate level, it can issue an instruction to turn down the humidifier so as to save power or avoid overheating. As an alternative, or additionally, the processor 23 may also issue a warning notice to inform a user that the humidifier should be filled with water as soon as possible. For example, the processor can send an alarm signal to call the user's attention, or playback a recorded speech to inform that there is not enough water in the humidifier.

Example 2

The water level monitoring unit 21 of the humidifier, according to another embodiment of the invention, also comprises a sampler 24 which is arranged to sample the temperature signals generated by the temperature sensor 22 and indicate the temperature at the air outlet as mentioned above with a certain frequency. Like in example 1, the sampler 24 can be a separate member of the water level monitoring unit. It is connected to the temperature sensor 22 to receive signals therefrom and connected to the processor 23 to send the sampled signals thereto. As an alternative, the sampler 24 can be an inside member of the temperature sensor 22. That is to say, the temperature sensor 22 can comprise such a sampler and integrate the function of said sampler. In addition, as an alternative, the sampler 24 can be an inside member of the processor unit. That is to say, the processor 23 may also comprise such a sampler or integrate the function of said sampler 24.

Unless explicitly stated otherwise, the components illustrated in example 2 will be the same or similar to those in example 1. The temperature sensor 22, the sampler 24 and the processor 23 as mentioned above are arranged to work together to implement such mechanisms as mentioned below, and shown in FIG. 4.

Figure 4:
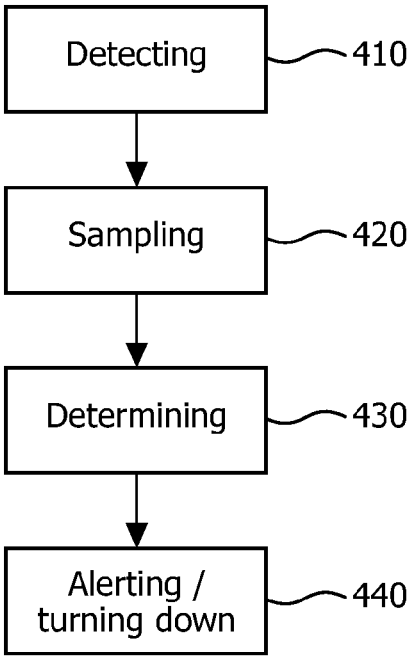
FIG. 4 shows a flow chart during a normal monitoring phase of the operation of a humidifier, according to an exemplary embodiment.

FIG. 4 shows a flow chart during the normal monitoring phase of the operation of a humidifier, according to an exemplary embodiment. In step 410, the temperature sensor 22 detects and measures the temperature during operation of the humidifier, and generates temperature signals representing the temperatures at the air outlet of the humidifier.

In step 420, the temperature signals generated by the temperature sensor 22 are sent to the processor with a second frequency at a normal monitoring phase of humidifier operation. The normal monitoring phase is a period from the end of the initial phase till the end of humidifier operation. The second frequency relates to sampling the signals every 15-50 seconds, preferably every 30 seconds. Actually, the second frequency can also have other appropriate values in the case of other design limitations. Generally speaking, the first frequency as mentioned above is higher than the second frequency, as the need to ascertain the water level in the initial phase is more imminent than in the normal monitoring phase. But that is not absolutely necessary for all arrangements.

In step 430, during the normal monitoring phase of humidifier operation, the processor 23 is arranged to determine the inclination of the temperature change from a series of consecutive sampled temperature signals, such as 10 consecutive signals. Especially, the processor 23 is arranged to determine whether the rate of temperature increase reaches a substantial value, which means that the water vapor cannot effectively lower the temperature, and this indirectly implies that there is not enough water left in the humidifier. The processor calculates the slope of the temperature increase from the sampled signals and compares it with a predetermined value or a range which can be designated by a user.

In the special example, for instance, if the slope of the temperature increase reaches a range of 0.05-0.35° C. per 30 seconds in the normal monitoring phase, then it can be inferred that there is not enough water in the humidifier. In other words, the water level is below a certain threshold. Otherwise, if the slope of the temperature increase does not reach a range of 0.05-0.35° C. per 30 seconds in the normal monitoring phase, then it can be inferred that there is still enough water in the humidifier. In other words, the water level is above a safety threshold, and identified as "high" or "appropriate". Then the water level monitoring unit 21 keeps on monitoring the temperature at the air outlet. It is noted that the other possible ranges may be also meaningful for describing the corresponding technical concept and content, when air temperature, water temperature, and other circumstances are taken into consideration.

In step 440, when the processor 23 determines that the water in the humidifier is not at an appropriate level, such as "low" or "empty", then it issues an instruction to a power supply unit to turn down the humidifier, so as to save power and/or avoid overheating. As an alternative, or additionally, the processor 23 may issue a warning notice that the humidifier should be filled with water as soon as possible.

Although example 1 and example 2 are described separately, the technical mechanisms can be incorporated together, while they can operate as described hereinabove (?). That is to say, the humidifier according to the invention can monitor the water level thereof both in the initial phase and in the normal monitoring phase in a manner as described above.

Example 3

Figure 5:
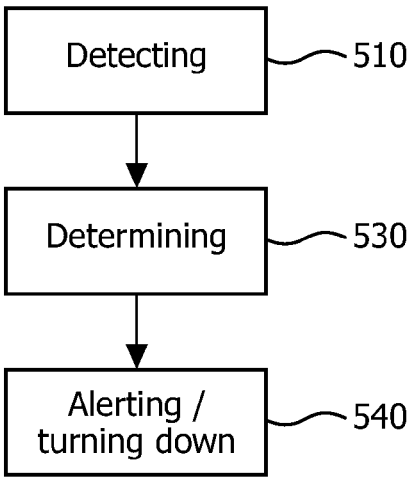
FIG. 5 shows a flow chart of water level monitoring of a humidifier according to another embodiment.

In respect of the water level monitoring unit 21 of the humidifier, according to another embodiment of the invention, the temperature sensor 22 can be arranged to detect and generate the temperature signals with a certain frequency. In this example, the temperature sensor itself can detect the temperature discontinuously with a first or a second frequency which can be programmed and adjusted. Thus, the temperature sensor can combine the temperature sensor and the sampler function in one element. That is, the steps of detecting and sampling as mentioned in the preceding examples 1 and 2 can be replaced with a step of discontinuously detecting the temperature with a variable frequency and generating discontinuous temperature signals. Thus, the steps 310, 320 in example 1 can be combined as a single step 510, or similarly the steps 410, 420 can also be combined as a single step 510, as shown in FIG. 5. And the other steps 530 and 540 are almost the same as those in examples 1 and 2, which will be easily understood by the ordinary technician.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In addition, there can be an A/D convertor in the water monitoring unit so as to convert analog temperature signals to digital signals. Or else, the temperature sensor itself has a digital function. In addition, the processor can be a general microprocessor being programmed with software, or it can be in the form of hardware, firmware. In addition, it is presumed that the water in a humidifier should be relatively cold water, i.e. an in-house temperature, but not hot water. The water temperature may affect the predetermined slope values or ranges.

It should be noted that the above-mentioned embodiments illustrate rather than limit the invention, and that those skilled in the art will be able to design many alternative embodiments without departing from the scope of the appended claims. In the claims, use of the verb "to comprise" and its conjugations does not exclude the presence of other elements or steps, and the article "a", or "an" preceding an element does not exclude the presence of a plurality of such elements. The mere fact that certain measures are recited in mutually different dependent claims does not indicate that a combination of these measures cannot be used to advantage. Any reference signs in the claims should not be construed as limiting the scope.

The invention claimed is:

1. A humidifier comprising:

a water level monitoring unit which comprises:

a temperature sensor for detecting the temperature at an air outlet and generating temperature signals indicating the temperature thereof at a predetermined frequency; and a processor means for determining the water level in the humidifier according to the temperature signals.

2. The humidifier apparatus according to claim 1, wherein the temperature sensor is arranged to sample the temperature signals at a first predetermined frequency during a first operational time period; and sample the temperature signals at a second predetermined frequency during a second operational time period.

3. The humidifier apparatus according to claim 1, wherein the first predetermined sampling frequency is once every 7 seconds and the first operational time period is from turn-on till the humidifier has operated for five minutes.

4. The humidifier apparatus according to claim 1, wherein the second predetermined sampling frequency is once every 30 seconds and the second operational time period starts after the humidifier has operated for five minutes.

5. The humidifier apparatus according to claim 1, wherein the processor means is arranged to:

determine the inclination of the temperature change from 5 consecutive samples, and determine whether the temperature drop within 45 seconds is in the range of 0.15-0.45° C., in the first time period;

and if so, determine that there is a substantial level of water in the humidifier, or if not, determine that there is not a substantial level of water in the humidifier.

6. The humidifier apparatus according to claim 1, wherein the processor means is arranged to determine the inclination of the temperature change from 10 consecutive samples, and determine whether the temperature rise within 30 seconds is in the range of 0.05-0.35° C., in the second time period;

and if so, identify that there is no substantial level of water in the humidifier, or if not, identify that there is a substantial level of water in the humidifier.

7. The humidifier apparatus according to claim 1, wherein the water level monitoring unit further comprises an alert unit, which issues a signal indicating that the humidifier needs to be filled with water, following an instruction from the processor means upon determining that there is no substantial level of water in the humidifier.

8. The humidifier apparatus according to claim 1, wherein the processor means is arranged to issue an instruction to turn down the humidifier apparatus upon determining that there is no substantial level of water in the humidifier.

9. A water level monitoring unit, used in a humidifier apparatus as claimed in claim 1, comprising:

a temperature sensor arranged at or near the air outlet of the humidifier apparatus, for detecting the temperature at the air outlet and generating a temperature signal indicating the temperature thereof at a predetermined frequency; and a processor means for determining the inclination of the temperature change over time and, consequently, whether there is a substantial level of water in the humidifier, based on the sampled signals.

10. A method of monitoring the water level in a humidifier, the method comprising the steps of:

a) detecting the temperature at the air outlet of the humidifier and generating temperature signals indicating the temperature thereof at a predetermined frequency; and b) determining the water level in the humidifier according to the processor, based on the generated temperature signals.

11. The method according to claim 10, wherein step a) further comprises:

generating temperature signals at a first pre-determined frequency during a first operational time period, the first operational time period being a predetermined time period from turn-on of the humidifier; and step b) further comprises:

determining whether a decreased temperature trend is shown by consecutive temperature signals generated during the first operational time period, in which case the water level is determined as high; otherwise, the water level is determined as low.

12. The method according to claim 11, wherein step a) further comprises:

generating temperature signals at a second pre-determined frequency during a second operational time period, the second operational time period being after the first operational time period, and the second pre-determined frequency is lower than the first pre-determined frequency; and Step b) further comprises:

determining whether an increased temperature trend is shown by consecutive temperature signals generated during the second operational time period, in which case the water level is determined as low.

13. The method according to claim 10, wherein the method further comprises:

if the water level of the humidifier is determined as low, indicating that the humidifier needs to be filled with water and/or turning down the humidifier.

* * * * *